US006063716A

United States Patent [19]

Granqvist

[11] Patent Number: 6,063,716

[45] **Date of Patent: *May 16, 2000**

[54] PROTECTIVE PANEL

[75] Inventor: Kaj Granqvist, Tåby, Sweden

[73] Assignees: Safeboard AB, Stockholm, Sweden; Modern Defense Technologies, Inc., Estacada, Oreg.

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,414

[22] Filed: Mar. 11, 1997

Related U.S. Application Data

[63] Continuation-in-part of application No. 08/615,776, Mar. 14, 1996, abandoned.

[51] Int. Cl.[7] ..... B32B 5/26

[52] U.S. Cl. ..... 442/246; 442/208; 442/239; 428/911

[58] Field of Search ..... 428/911; 442/135, 442/208, 239, 246

[56] References Cited

U.S. PATENT DOCUMENTS

| | | | |
|---|---|---|---|
| 4,522,871 | 6/1985 | Armellino, Jr. et al. | 428/911 |
| 4,678,702 | 7/1987 | Lancaster et al. . | |
| 5,198,280 | 3/1993 | Harpell et al. | 428/911 |
| 5,440,965 | 8/1995 | Cordova et al. | 428/911 |
| 5,565,264 | 10/1996 | Howland | 428/911 |

FOREIGN PATENT DOCUMENTS

| | | |
|---|---|---|
| 0 559 386 A1 | 6/1994 | European Pat. Off. . |
| WO 92/06841 | 4/1992 | WIPO . |

*Primary Examiner*—Terrel Morris
*Attorney, Agent, or Firm*—Kolisch, Hartwell, Dickinson, McCormack & Heuser

[57] ABSTRACT

The invention concerns a panel for protection against projectiles, splinter, etc. The panel is primarily arranged to supplement the outer shell of a vehicle such that the overall protection against such projectiles is considerably increased without the weight of the vehicle or the like being increased in any essential aspect. The panel includes a two digit number of layers of woven fibers, made from yarns of aramid or corresponding material. The layers are put on top of each other in the direction of incidence of a projectile etc. against the panel.

8 Claims, 3 Drawing Sheets

PROTECTIVE PANEL

CROSS-REFERENCE TO RELATED APPLICATION

This application is a continuation-in-part of U.S. patent application Ser. No. 08/615,776 filed Mar. 14, 1996, now abandoned, which was refiled as Ser. No. 08/926,551 on Sep. 10, 1997, now U.S. Pat. No. 5,903,920, which is hereby incorporated by reference.

TECHNICAL FIELD

The present invention relates to a panel for protection against projectiles, splinter, bullets, etc. The panel primarily is arranged to supplement the outer shell or carapace of a vehicle such that the overall protection against such projectiles or the like is considerably increased without the weight of the vehicle or the like being increased in any essential aspect. Said panel is including a two-digit number of layers of woven fibres, made from yarns of aramid or corresponding material, which layers are put on top of each other in the direction of incidence of a projectile etc. against the panel.

BACKGROUND ART

Protective panels using woven fibres of aramid and related materials are previously known in different designs. Such known designs are, for example, disclosed by U.S. Pat. No. 4,678,702, PCT Application No. W092/06841 and by the European Patent Application No. 0 599 386 A1, the last one filed by the present inventor as well.

Said known protective panels are as such relatively stiff and are, thus, difficult to use when, for example, one wishes to locate the pre manufactured protective panels in the doors of vehicles between the outer shell of the vehicle and the inside door paneling and in other spaces present in the vehicles.

The depth available for such protective panels in doors of vehicles is very limited and ranges from about 0.8 centimeters to about 2.0 centimeters. The available space varies in thickness and is difficult to reach because other structures means are present in said spaces like levels, door locks, window hoist means, and so on. A relatively flexible protective panel is apparently easier to install.

The limited spaces available in such doors of vehicles mean that it is difficult to provide a panel effective as protection against bullets from guns due to the fact that there is not enough space available to provide the protection desired.

It is, of course, always possible to use heavy weighted steel plates or corresponding materials but the weights added in such cases to the vehicle would create other drawbacks like requiring very expensive and time consuming modifications to the vehicle, larger fuel consumption of the vehicle and so on.

OBJECT OF THE INVENTION

When using woven fabrics of, for example, aramid type as an obstacle or shield against bullets, the number of cross points between warp and weft yarns per square unit is an important factor because the cross points create the resistance to a bullet hitting the woven fabric. Therefore, it is advantageous to use yarn of small diameter so that as many layers of woven fabrics as possible can be used in the available space.

Thus, an object of the present invention is to provide a protective panel possible to insert in limited spaces in vehicles without high expenses for its manufacture and mounting, aramid or similar woven fabrics of low weight per square unit for providing effective protection against striking projectiles, bullets, and so on and, furthermore, to dispose the cross points in one layer of woven fibres so that they are displaced in relation to the cross points of another layer of woven fibres laying next to said one layer, even if said layers are not tightly interconnected.

The objects and tasks specified above have been solved in accordance with the present invention by means of the panel as mentioned in the descriptive preamble in that said two-digit number of layers includes two or more layers having mutually different mesh sizes. Said layers with different mesh sizes are ununiformally distributed in the panel along said direction of incidence of a projectile etc. against the panel.

A particularly advantageous embodiment of the present invention is if the different mesh sizes in two or more layers are created by using lower and higher cover factors, respectively, in the weaves of said two or more layers and/or if the different mesh sizes in two or more layers are created by using yarns having mutually different diameters in the weaves of said two or more layers.

BRIEF DESCRIPTION OF THE ACCOMPANYING DRAWINGS

The present invention will be described in greater details herein below, with particular reference to an embodiment chosen by way of example and with particular reference to the accompanying drawings.

FIG. 1 is a schematic perspective view, in a direction from the inside of a vehicle door, of one small part of an example panel according to the present invention, FIG. 2 shows a schematic side view over said one small part of the example panel according to FIG. 1 but with an incoming bullet traveling from right to left as seen therein, FIG. 3 shows transversely of the direction of incidence for an incoming bullet how the layers of woven fabrics are mutually displaced and inclined, and FIG. 4 shows a schematically protective door panel according to the present invention in side view.

DETAILED DESCRIPTION OF THE INVENTION

A protective panel according to the present invention includes a large number of layers of woven fabric of the aramid or similar type of materials having low weight in relation to its ability to resist bullets, projectiles or the like when striking the woven fabrics. In order to fit into the empty spaces available in vehicles like automobiles the aggregated number of layers of woven fabrics must be less then one hundred and usually less than half of that number.

Figure 1:
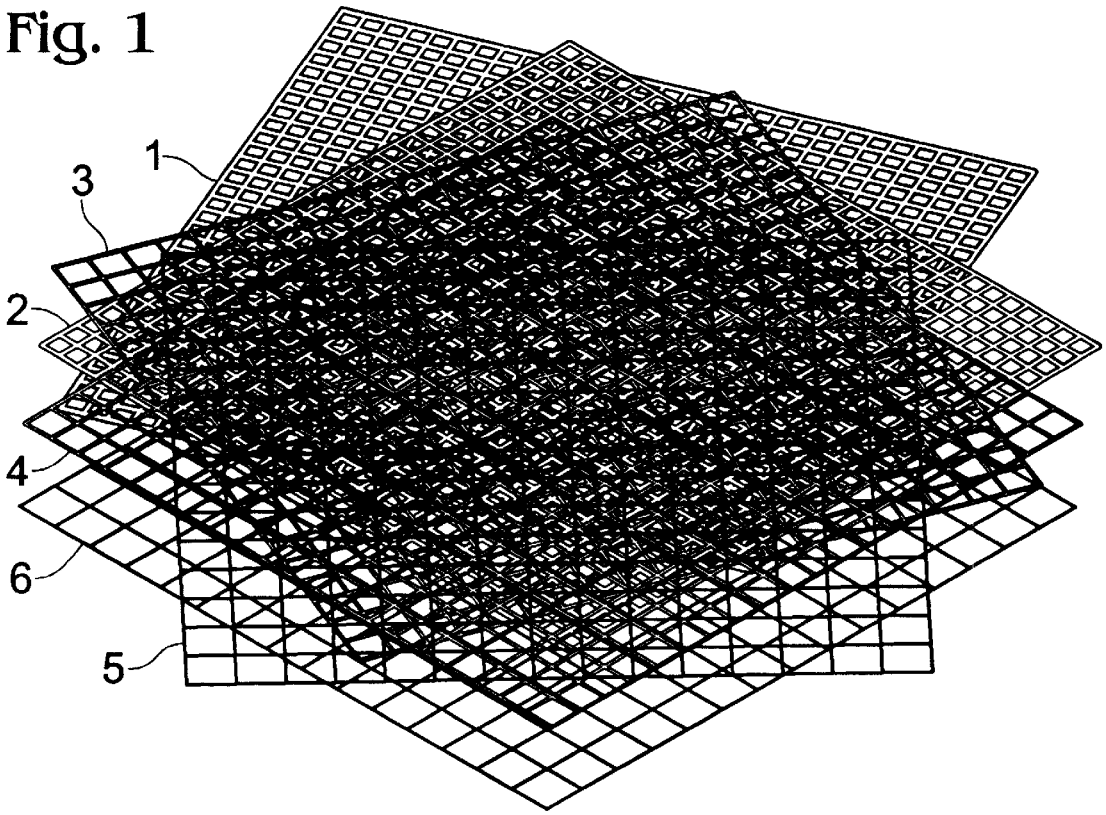
Figure 2:
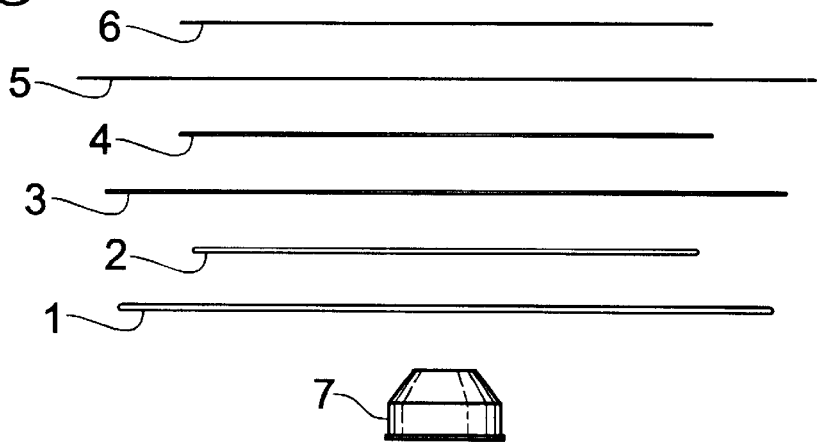
Figure 3:
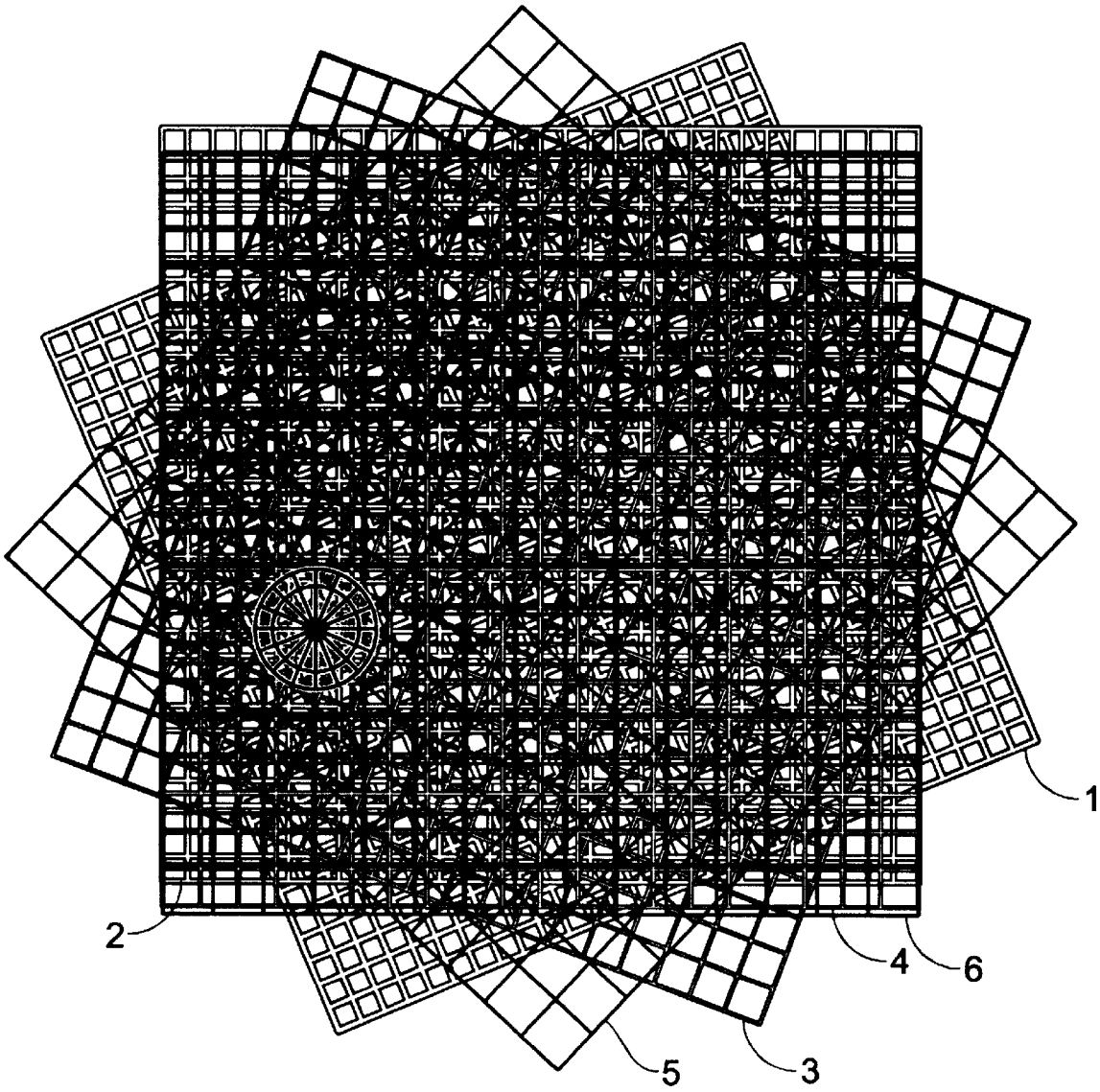

In FIGS. 1 to 3 of the present invention, six layers 1–6 of woven fabrics have been shown very much enlarged for the sake of clarity.

As shown in FIG. 2, in the direction of incidence for a bullet 7 against the six layers 1–6 of woven fabrics the layer 1 is the first one which is hit by bullet 7 besides the steel shell of the vehicle not shown in the drawing. Layer 1 is manufactured with a high cover factor, i.e., the yarns in warp and weft are tightened very close to each other and, thus, the corresponding mesh opening is very small. The weight of this layer is chosen to be 460 grams per square meter.

The next layer hit by the bullet 7 is layer 2. Layer 2 is, in this example, manufactured exactly in the same way as and from the same material as layer 1 but is rotated, as shown in FIG. 1.

Layers 1 and 2 are chosen, for example, so that if they are mutually rotated, then, the cross points of layer 1 will be displaced from the cross points of layer 2. Thus, incoming bullet 7, moving before hitting layer 1 in a direction of incidence, will in layer 1 be confronted with resistance, wherein resistances in the warp and weft directions are essentially the same but in the diagonal direction between warp and weft the resistance will be lower. Consequently, bullet 7 will by the first layer 1 receive a tendency to deviate from said one direction of incidence and in layer 2, bullet 7 will meet warp and weft directions which are different from the ones in layer 1. Thus, the small deviation in the moving direction of bullet 7 created by layer 1 will be increased by layer 2.

As bullet 7 travels through the layers, it hits layer 3. Layer 3, for example, is manufactured from woven fibres weighting 280 grams per square meter and has a lower cover factor than layers 1 and 2. Layer 3 is created from yarns with smaller diameters than in layers 1 and 2. Furthermore, layer 3 may also be somewhat rotated relative to layer 2 to further ensure that the cross points of layer 3 are displaced relative to the cross points of layer 2. Accordingly, bullet 7 will further deviate from its prior direction when running through layer 3.

Layer 4 is made of the same material as layer 3 but is somewhat rotated relative to layer 3, as show FIG. 1. In the same way as described above, the bullet 7 will further deviate in direction when running through layer 4.

Bullet 7 then hits layer 5, which in this example is chosen to be manufactured from woven fibres weighting 200 grams per square meter. Layer 5 has a lower cover factor than layers 3 and 4, and is created, for example, by yarns with smaller diameters than in layers 3 and 4. Furthermore, said layer 5 is rotated relative to layer 4 to further ensure that the cross points of said layer 5 are displaced relative to the cross points of layer 4. Thus, in the same way as previously described, bullet 7 will further deviate in direction when running through layer 5.

Layer 6 is manufactured in the same way as and from the same material as layer 5 but is somewhat rotated relative to layer 5, as shown in FIG. 1. In the same way as previously described, bullet 7 further deviates in direction when running through layer 6.

In the example as specified above until now, the structure of the panel is made of individual layers of woven fibres, preferably aramid, laid on top of each other creating a displacement of a bullet hitting the panel and, thus, creating a braking movement to a bullet penetrating the composite panel over a longer distance than the thickness of the panel due to the fact that a deviation in the direction of travel of the bullet through the panel is caused. However, the capacity for providing displacement of a bullet can be further improved by using sets of layers, which are composed of, for example two, three, or in certain cases four layers, each layer made from a mesh size, which differs from the other layers in said set, and each layer with a given mesh size located in a different position in the next set.

An example of a protective panel as described above includes, as seen in the direction of incidence of a bullet traveling toward the panel, a 1st layer consisting of woven aramid fibres weighting 460 grams per square meter, a 2nd layer consisting of woven aramid fibres weighting 460 grams per square meter, a 3rd layer consisting of woven aramid fibres weighting 200 grams per square meter, a 4th layer consisting of woven aramid fibres weighting 280 grams per square meter, a 5th layer consisting of woven aramid fibres weighting 280 grams per square meter, a 6th layer consisting of woven aramid fibres weighting 460 grams per square meter, a 7th layer consisting of woven aramid fibres weighting 200 grams per square meter, a 8th layer consisting of woven aramid fibres weighting 280 grams per square meter, a 9th layer consisting of woven aramid fibres weighting 280 grams per square meter, a 10th layer consisting of woven aramid fibres weighting 460 grams per square meter, a 11th layer consisting of woven aramid fibres weighting 200 grams per square meter, a 12th layer consisting of woven aramid fibres weighting 280 grams per square meter, a 13th layer consisting of woven aramid fibres weighting 280 grams per square meter, a 14th layer consisting of woven aramid fibres weighting 460 grams per square meter, a 15th layer consisting of woven aramid fibres weighting 200 grams per square meter, a 16th layer consisting of woven aramid fibres weighting 280 grams per square meter, a 17th layer consisting of woven aramid fibres weighting 280 grams per square meter, a 18th layer consisting of woven aramid fibres weighting 460 grams per square meter, a 19th layer consisting of woven aramid fibres weighting 200 grams per square meter, a 20th layer consisting of woven aramid fibres weighting 280 grams per square meter, a 21st layer consisting of woven aramid fibres weighting 280 grams per square meter, a 22nd layer consisting of woven aramid fibres weighting 460 grams per square meter, a 23rd layer consisting of woven aramid fibres weighting 200 grams per square meter, a 24th layer consisting of woven aramid fibres weighting 200 grams per square meter, a 25th layer consisting of woven aramid fibres weighting 280 grams per square meter, a 26th layer consisting of woven aramid fibres weighting 280 grams per square meter, a 27th layer consisting of woven aramid fibres weighting 460 grams per square meter, a 28th layer consisting of woven aramid fibres weighting 460 grams per square meter, a 29th layer consisting of woven aramid fibres weighting 200 grams per square meter and a 30th layer consisting of woven aramid fibres weighting 200 grams per square meter. Furthermore, a cover enclosing all said layers is used weighting 200 grams per square meter and giving a total weight for such a composed panel per square meter of 9.5 kilograms.

The example as specified above is not intended to limit the present invention to the layers as specified above or to the sets of layers as specified above. For example, the weight of each woven fibre per square meter might vary between 100 to at least 700.

In a panel as composed above, the deviation in direction for the bullet hitting the panel between the first layer 1 and the last layer where it stopped was measured to about 30 mm.

Figure 4:
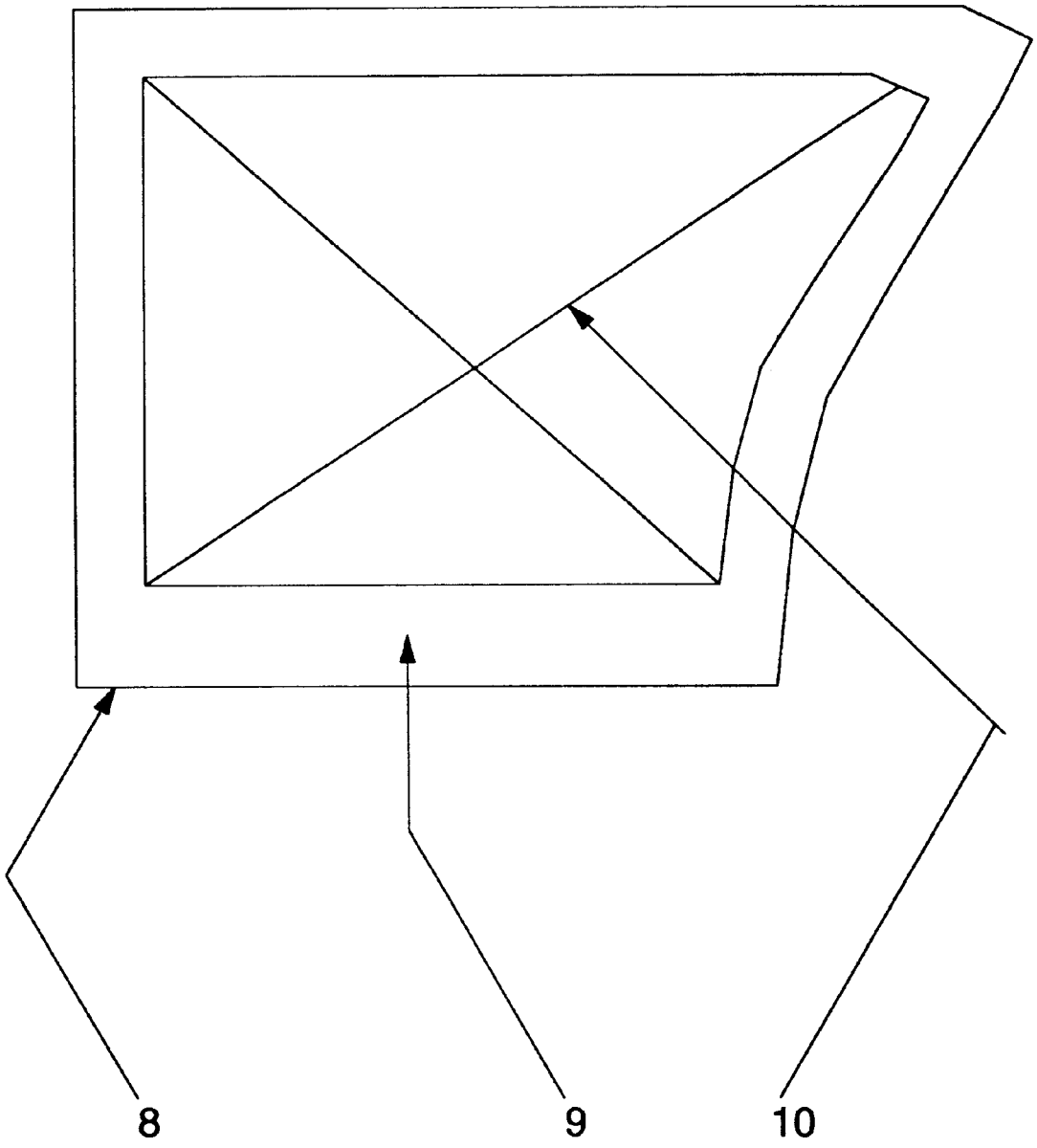

In FIG. 4, there is shown how a door panel 8 might be manufactured. By sewing or stitching the layers, previously laid on top of each other in the order and with the directions as specified above, along the crossing lines marked with 10 in FIG. 4. The layers create a relatively flexible panel. Furthermore, the outer edges marked with 9 in FIG. 4 should be very flexible and a further sewing or stitching can be arranged if desired along the line inside the edge marked with 9 to provide a somewhat stiffer panel but still very flexible at the outer edge 9. It is, of course, also required in certain cases to provide holes and vents to ease the mounting of the panel.

What is claimed is:

1. A protective panel for blocking a potentially dangerous incoming object, comprising at least ten layers of woven fibres stacked on top of each other, wherein at least two of the layers have mutually different mesh sizes, the different mesh sizes being created by providing (a) the warp yarn diameter in one of the two layers being different from the weft yarn diameter in the same layer, and (b) the yarns in one of the two layers having a different diameter from the yarns in the other of the two layers, wherein one of the two layers has warp and weft directions that are rotated and obliquely oriented relative to warp and weft directions of the other of said two layers.

2. The protective panel of claim 1 wherein the woven fibres are aramid.

3. The panel of claim 1 wherein the two layers have different cover factors.

4. A panel for protection against potentially dangerous incoming objects, comprising a two-digit number of layers of woven fibres, made from yarns of aramid, which layers are put on top or each other in a predicted direction of incidence of a potentially dangerous incoming object against the panel, and wherein said two-digit number of layers includes at least two layers having mutually different mesh sizes, wherein the different mesh sizes are created by providing (a) the warp yarn diameter in one of the two layers being different from the weft yarn diameter in the same layer, and (b) the yarns in one of the two layers having a different diameter from the vamp in the other of the two layers.

5. The panel as claimed in claim 4, wherein the different mesh sizes in at least two layers are created by using lower and higher cover factors, respectively, in the weaves of said two layers.

6. The panel as claimed in claim 4, wherein said at least two layers with mutually different mesh sizes include plural sets of three layers, the layers in each set being located along said predicted direction of incidence of a potentially dangerous incoming object.

7. The panel as claimed in claim 6, wherein the number of sets of layers is at least three.

8. The panel as claimed in claim 6, wherein the weight of each layer ranges from 100 grams per square meter to 600 grams per square meter.

* * * * *